United States Patent [19]

Gordon

[11] Patent Number: 4,664,602

[45] Date of Patent: May 12, 1987

[54] CONTROLLER FOR PLUNGER LIFT SYSTEM FOR OIL AND GAS WELLS

[75] Inventor: Bernard L. Gordon, Houston, Tex.

[73] Assignee: Artificial Lift Systems, Inc., Houston, Tex.

[21] Appl. No.: 808,670

[22] Filed: Dec. 13, 1985

Related U.S. Application Data

[63] Continuation of Ser. No. 656,481, Oct. 1, 1984, abandoned, which is a continuation-in-part of Ser. No. 624,211, Jun. 25, 1984, abandoned.

[51] Int. Cl.[4] ..... F21B 34/16

[52] U.S. Cl. ..... 417/56; 137/624.15; 166/53; 340/853; 364/422; 417/58

[58] Field of Search ..... 417/56, 57, 58, 63; 166/53; 137/624.15, 624.20; 364/422; 340/853

[56] References Cited

U.S. PATENT DOCUMENTS

| | | | |
|---|---|---|---|
| 3,351,021 | 11/1967 | Moore, Jr. | 417/57 |
| 3,467,875 | 9/1969 | Engle | 364/422 X |
| 4,150,721 | 4/1979 | Norwood | 166/53 |
| 4,227,862 | 10/1980 | Andrew et al. | 417/12 |
| 4,352,376 | 10/1982 | Norwood | 137/624.15 |
| 4,355,365 | 10/1982 | McCracken et al. | 364/569 |
| 4,410,038 | 10/1983 | Drapp | 417/57 X |

*Primary Examiner*—Carlton R. Croyle
*Assistant Examiner*—T. Olds
*Attorney, Agent, or Firm*—Vaden, Eickenroht, Thompson & Boulware

[57] ABSTRACT

A controller is disclosed for a plunger lift system for oil and gas wells that monitors the casing pressure, flow line pressure, and battery voltage and overrides the on-time and off-time periods to either shut the well in or open the flow line valve when certain casing or flow line pressures exist or when the battery voltage drops to a preselected minimum.

1 Claim, 2 Drawing Figures

Figure 1:
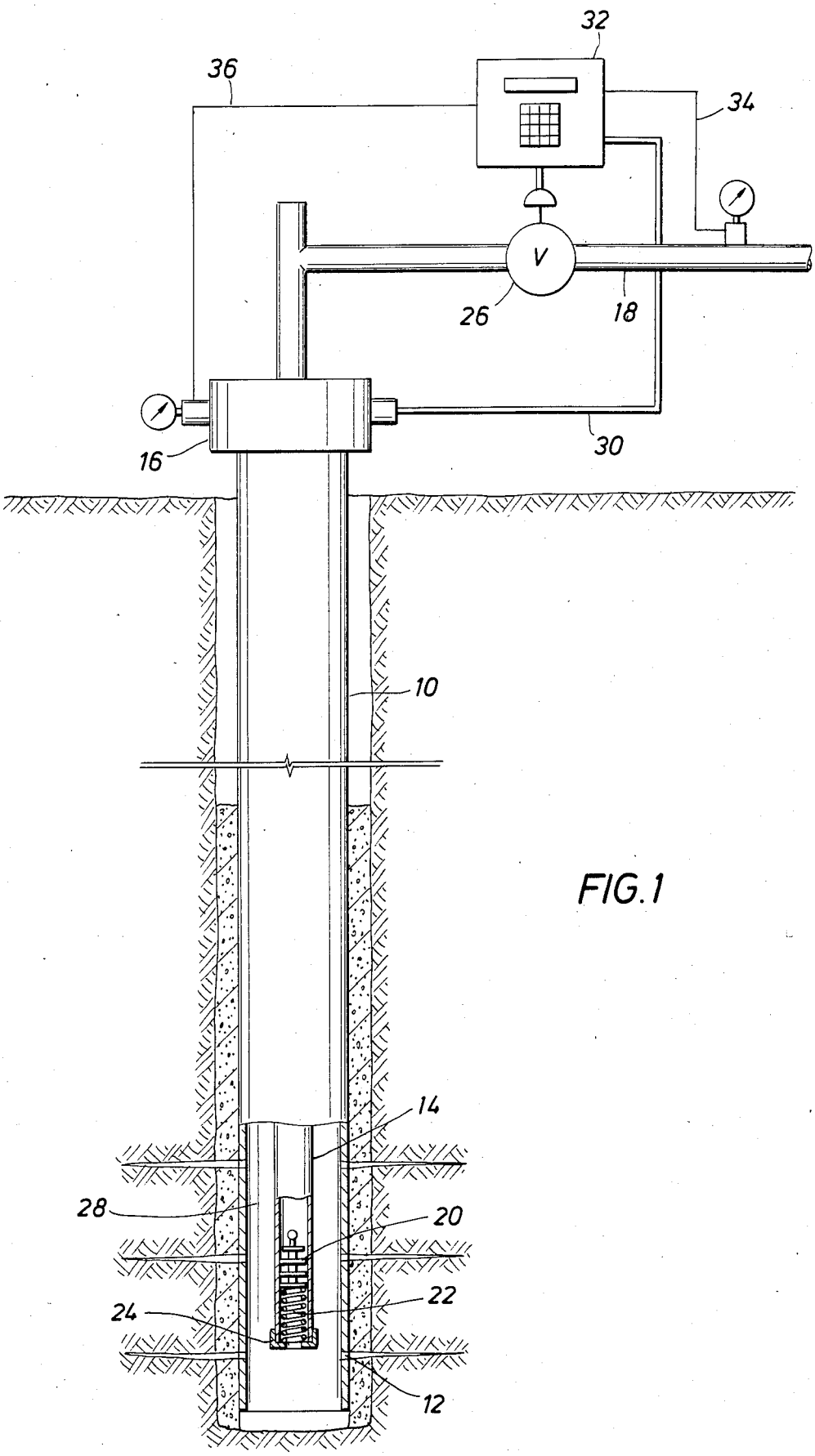

COMPARATOR
49
BATTERY VOLTAGE
46
BATTERY
MICROPROCESSING UNIT
44
48
ANALOG TO DIGITAL CONVERTER
LINE PRESSURE
CASING PRESSURE
32
ALPHAMERIC DISPLAY (16 CHARACTERS)
PRESSURE BROKE
40
1 2 3 C
4 5 6 PGM
7 8 9 P
CNT 0 CL/OP ENT
42
33
26
30
18

CONTROLLER FOR PLUNGER LIFT SYSTEM FOR OIL AND GAS WELLS

This application is a continuation of application Ser. No. 06/656,481, filed on Oct. 1, 1984, now abandoned, which is a continuation-in-part of Ser. no. 624,211, filed June 25, 1984 now abandoned, entitled "Controller for Plunger Lift System for Oil and Gas Wells."

This invention relates generally to controllers for plunger lift systems for oil and gas wells and more particularly to such a controller that is fail-safe.

In a plunger lift system of the type with which the controller of this invention is used, the energy for moving the plunger from its location downhole to the surface through the well tubing is supplied by the well itself. The well produces gas, but not enough to continuously carry the liquid produced by the well to the surface. Consequently, the well is shut in to allow the gas pressure to build up sufficiently to lift the liquid collected in the well bore to the surface. This energy is usually depleted rapidly and the well must be shut in again to allow the gas pressure to build up. A plunger is used to increase the volume of liquid the gas can lift to the surface.

The controller of this invention includes a microprocessing unit that can be programmed to shut the well in for a preselected period of time (off-time) and then to open the valve in the flow line for a preselected period of time (on-time) and allow the gas that has accumulated in the casing annulus between the tubing and the casing to U-tube around the bottom of the open-ended tubing and push a plunger located at the lower end of the tubing to the surface carrying liquid that has accumulated above the plunger to the surface ahead of the plunger. The well is then shut in again to allow the gas pressure to rebuild in the casing annulus and the cycle is repeated.

Since these controllers are often on wells in remote locations where they may be checked at most once a day, it is important that certain abnormal conditions can override the programmed well open and well closed cycles of the controller and shut the well in until the operator corrects the abnormal condition that exists.

Therefore, it is an object of this invention to provide a controller for a plunger to lift system for oil and gas wells that will shut the well in permanently should the voltage of the battery supplying the power to the controller reach a preselected minimum voltage.

It is another object of this invention to provide such a controller that monitors the casing pressure and the flow line pressure and that will override the on-time and off-time cycles of the controller should certain pressure conditions exist. For example, if the flow line pressure exceeds a given pressure or drops below a given pressure, the controller will cancel any remaining on-time if the flow line valve is open and shut the well in or will prevent the flow line valve from being opened if it is closed under those conditions. In addition, should casing pressure exceed a given preselected maximum, the controller will cancel any remaining off-time and open the flow line valve to allow this pressure to go through a plunger lifting cycle. In addition, should the casing pressure drop below a preselected pressure, the controller will cancel any remaining on-time and shut the well in and if the well is shut in, continue to keep the well shut in until the pressure has built up again.

These and other objects, advantages and features of this invention will be apparent to those skilled in the art from a consideration of this specification including the attached drawings and appended claims.

Figure 2:
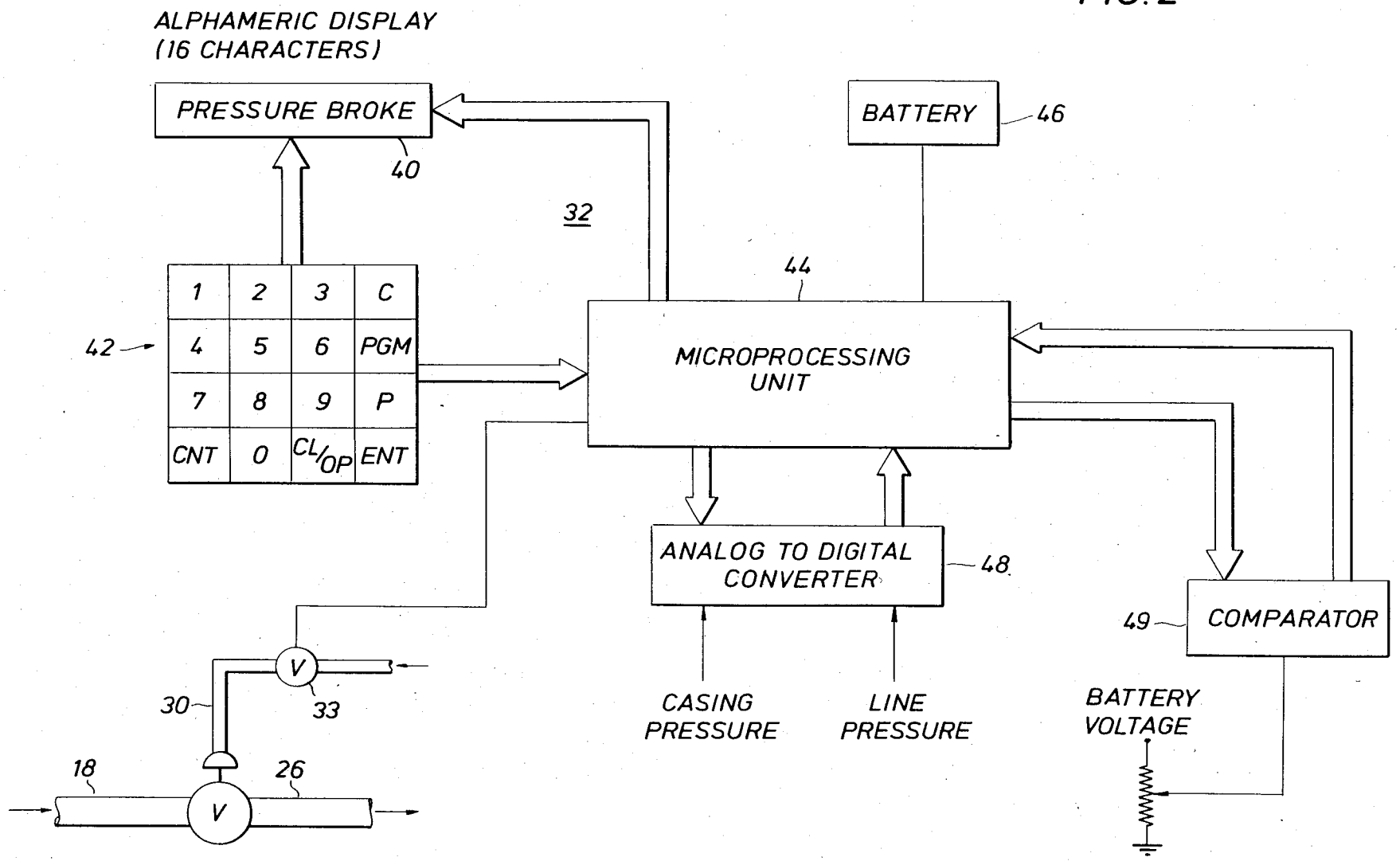

In the drawings,

FIG. 1 is a schematic view partly in section and partly in elevation of a producing oil or gas well equipped with a plunger lift system and the controller of this invention; and FIG. 2 is a block diagram of the controller of this invention.

When reference herein is made to an oil or gas well, it does not mean that a well produces only oil or only gas. Obviously, a well can produce both oil and gas and usually does. It is referred to as being either an oil or gas well depending upon the dollar value of the fluid produced. In other words, a gas well will be one that produces gas in commercial quantities. Other liquids may be produced and usually are but they are of substantially less commercial value. A well that produces mostly oil is called an oil well although it can and usually does produce gas with the oil.

A typical producing well includes a casing string 10 as shown in FIG. 1. The casing is perforated as shown to allow fluids from the producing formation to enter the casing through perforations 12. A string of smaller diameter pipe 14, usually referred to as tubing, is suspended from wellhead 16 attached to the top of the casing. It is through the tubing that the fluid produced by the well travels to the surface. Flow line 18 carries the produced fluid to a separator or the like downstream.

In a plunger lift system, plunger 20 will rest against bottom hole bumper spring 22 somewhere adjacent the bottom of the tubing, when the well is shut in. The bumper spring rests on tubing stop or standing valve 24. The bottom of the tubing is open. In operation, the well is shut in by motor valve 26. Gas will enter the casing from the producing formation and build up the pressure in annulus 28 between the casing and the tubing over a period of time. When this pressure is sufficient, valve 26 will be opened. The gas in casing annulus 28 will U-tube around the bottom of tubing 14 and force plunger 20 to the surface. The plunger will carry ahead of it the liquid that has accumulated above the plunger in the tubing during the period of time that the well has been shut in. After the plunger reaches the surface, flow line valve 26 is closed, and the plunger falls back to the bottom of the tubing in preparation for another cycle.

Motor valve 26 is usually opened by pneumatic pressure. Quite commonly, as shown in FIG. 1, the pneumatic pressure is obtained from wellhead 18 through line 30. Normally the pressure of the gas at the wellhead is higher than that desired to operate motor valve 26 so pressure regulator (not shown) is installed in actuator line 30 to reduce the pressure to approximately 25 p.s.i.

As shown in FIG. 1, actuator line 30 reaches motor valve 26 through controller 32 in which is located an electrically operated valve 33 (not shown in FIG. 1) that controls when pneumatic pressure is supplied to motor valve 26 to cause it to open. Flow line pressure downstream of motor valve 26 is fed to controller 32 through line 34 and casing pressure is supplied to controller 32 through line 36. The controller monitors these pressures and, as will be explained below, takes certain action depending upon changes in the flow line and casing pressures.

Controller 32 includes alphanumeric display 40 that can display up to 16 characters, either numbers or letters. As shown in FIG. 2, it is displaying the signal "Pressure Broke." As will be explained below, this is what will appear on the screen when the controller has determined that there has been a malfunction in the pressure measuring apparatus.

The controller also includes keyboard 42 that is used to set the time off and time on periods for the motor valve. The keyboard is connected to microprocessing unit 44, which includes a microprocessor, whatever read only memories are required for the program, and the usual buffer, clock, and driver circuits associated with a microprocessing unit. The controller also includes battery 46 analog to digital converter 48, and comparator 49.

In operation, the controller will be programmed to operate on two time periods. In other words, the operator will, through the keyboard, tell the microprocessing unit how long he wants the valve to be closed and how long he wants it to be open. Alternatively, he can have the arrival of the plunger at the surface turn off the on-time and close the valve in the flow line. Often, however, it is desired to have the valve stay open for a period of time following the arrival of the plunger at the surface. This can all be programmed into the microprocessing unit through keyboard 42. The microprocessing unit then will keep valve 33 in actuator pressure line 30 closed for a programmed period of time, say four hours, after which the microprocessing unit will open valve 33. This will supply pneumatic pressure to motor valve 26 and open flow line 18. The plunger will now be moved to the surface by the gas pressure and then either upon its arrival at the surface or after a programmed period of time, the microprocessing unit will close valve 33, which in turn will cause valve 26 to close and shut the well in.

As explained above, one of the objects of this invention is to provide a failsafe controller, one that will not allow flow line 18 to be left open under conditions where the controller is not functioning properly or when certain other conditions exist.

One of the features of this invention is to monitor the output voltage of battery 46 and shut the well in when the battery voltage reaches a preselected minimum. This is done by supplying comparator 49 with battery voltage. The comparator continuously compares a percentage of battery voltage with an a slightly smaller internal reference voltage. When the battery voltage drops below the internal reference voltage, the comparator will change states signaling the microprocessing unit will close valve 33 and shut down all other operations of the controller.

Another condition requiring changes in the planned sequence of events for the controller is where casing pressure increases faster than expected and consequently if valve 26 is not opened early, valuable production will be lost. Therefore, an electrical signal proportional to casing pressure is supplied to A/D converter 48 where it is continuously compared to a programmed high and low pressure level. If the casing pressure reaches this preselected pressure during an off-time period the microprocessing unit will cancel the remaining off-time and immediately open valve 33 and valve 26. If casing pressure drops below the selected low pressure, which usually happens when valve 26 is open, then there is a danger that there will not be enough energy to completely move the plunger to the surface and what remaining gas pressure there is will be depleted without doing any efficient work. Therefore, at that point, the microprocessor will cancel the remaining on-time and immediately close valve 33, which will also close flow line valve 26.

Another condition that controller 32 monitors through A/D converter 48 is flow line pressure downstream of valve 26. Should, for example, flow line pressure downstream of the well be unusually high, which can occur where several wells are producing into one separator that may be overloaded from time to time, microprocessing unit 44 will immediately cancel any on-time remaining if valve 26 is open or prevent valve 26 from being opened until the pressure condition in the flow line has been corrected. On the other hand, if flow line pressure drops below a preselected value, which indicates that the flow line is broken, the controller will cancel any on-time remaining if valve 26 is open or prevent the valve from being opened until the low pressure condition is corrected.

Since many of the safety features of controller 32 are based upon comparing casing pressure and flow line pressure with programmed minimums and maximum pressures, it is important that the information coming to the microprocessor and A/D converter be monitored to make sure that the signals being received are accurate. For this purpose, A/D converter 48 is supplied with a signal that is one-half of expected casing pressure. If one-half of the expected casing pressure signal received by the comparator varies substantially from that, the microprocessor will determine that the A/D converter is not operating properly and will cause the words "Pressure Broke" to appear on the alphanumeric display panel. It will also immediately cancel any remaining on-time and close flow line valve 26, if open or prevent valve 26 from opening.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A controller for a plunger lift system in which a pneumatically operated motor valve in the flow line of a producing well is opened intermittently to allow gas in the annulus between the well tubing and well casing to move a plunger through the tubing to the surface from a downhole position to force fluid in the tubing into the flow line, said controller comprising a microprocessing unit including a microprocessor, an A/D converter, and a programmable read only memory, a keyboard for programming the memory for a preselected period of off-time that the flow line valve is to be closed followed by a preselected period of on-time that the flow line valve is to be open during which latter time period the microprocessing unit causes pneumatic pressure to be supplied to the motor valve in the flow line to hold it open, pressure measuring means for continuously supplying the microprocessing unit with electrical signals proportional to the pressure in the casing annulus and in the flow line, and means responsive to a programmed maximum pressure in the casing annulus to reduce any remaining off-time to zero and open the valve in the flow line, means responsive to a programmed low casing pressure to cancel any remaining on-time to close the valve in the flow line, means responsive to programmed high or low pressure in the flow line to cancel any remaining on-time, if any, and close the flow line valve and to prevent the valve from being opened as long as the high or low pressure exists in the flow line, means for comparing the casing pressure signal with a programmed value for the expected pressure in the casing and to cancel any remaining on-time, if any, and close the flow line valve and prevent the valve from being opened when the pressure signal is such as to indicate a malfunction of the measuring means, and a battery for supplying the electrical power for the controller and means for comparing a fraction of the output voltage of the battery when fully charged with a preselected lower voltage and for preventing pneumatic pressure from being supplied to the motor valve when the voltage supplied by the battery drops below said preselected minimum.

* * * * *